US007928375B1

(12) United States Patent
Mangan et al.

(10) Patent No.: US 7,928,375 B1
(45) Date of Patent: Apr. 19, 2011

(54) MICROFABRICATED LINEAR PAUL-STRAUBEL ION TRAP

(75) Inventors: Michael A. Mangan, Albuquerque, NM (US); Matthew G. Blain, Albuquerque, NM (US); Chris P. Tigges, Albuquerque, NM (US); Kevin L. Linker, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 287 days.

(21) Appl. No.: 12/254,932

(22) Filed: Oct. 21, 2008

Related U.S. Application Data

(60) Provisional application No. 60/982,160, filed on Oct. 24, 2007.

(51) Int. Cl.
*H01J 49/26* (2006.01)

(52) U.S. Cl. ..... 250/292; 250/283; 250/291
(58) Field of Classification Search ..... 250/292
See application file for complete search history.

(56) References Cited

U.S. PATENT DOCUMENTS

| | | | | |
|---|---|---|---|---|
| 5,248,883 | A * | 9/1993 | Brewer et al. | 250/292 |
| 6,870,158 | B1 * | 3/2005 | Blain | 250/292 |
| 6,903,337 | B2 * | 6/2005 | Kienzle et al. | 250/306 |
| 7,012,250 | B1 * | 3/2006 | Aksyuk et al. | 250/292 |
| 7,081,623 | B2 * | 7/2006 | Pai et al. | 250/299 |
| 7,154,088 | B1 | 12/2006 | Blain et al. | |

OTHER PUBLICATIONS

Z. Ouyang et al, "Quadrupole ion traps and trap arrays: geometry, material, scale, performance", Eur. J. Mass Spectrom., vol. 13, (2007) pp. 13-18.
J. Chiaverini, et al, "Surface-Electrode Architecture for Ion-Trap Quantum Information Processing", Quantum Information and Computation, vol. 5, No. 6 (2005), pp. 419-439.
S. Seidelin et al, "Microfabricated Surface-Electrode Ion Trap for Scalable Quantum Information Processing", Physical Review Letters, (2006), vol. 96, pp. 253003-1 through 253003-4.
C. E. Pearson, et al, "Experimental investigation of planar ion traps", Physical Review A 73, pp. 032307-1 through 032307-12 (2006).
N. Yu et al, "Analysis of Paul-Straubel trap and its variations", Journal of Applied Physics, vol. 77, No. 8, Apr. 15, 1995, pp. 3623-3630.
G. R. Janik et al, "Simple analytic potentials for linear ion traps", Journal of Applied Physics, vol. 67, No. 10, May 15, 1990, pp. 6050-6055.
Jae C. Schwartz, et al, "A Two-Dimensional Quadrupole Ion Trap Mass Spectrometer", J. Am. Soc. Mass Spectrom. 2002, vol. 13, pp. 659-669.
Wan, Jin-Yin et al, "Surface Planar Ion Chip for Linear Radio-Frequency Paul Traps", Chin. Phys. Lett, vol. 24, No. 5 (2007) pp. 1238-1241.
Donald J. Douglas et al, "Linear Ion Traps in Mass Spectrometry", Mass Spectrometry Reviews, (2005, vol. 24, pp. 1-29.

* cited by examiner

*Primary Examiner* — Phillip A Johnston
(74) *Attorney, Agent, or Firm* — Kevin W. Bieg

(57) ABSTRACT

An array of microfabricated linear Paul-Straubel ion traps can be used for mass spectrometric applications. Each ion trap comprises two parallel inner RF electrodes and two parallel outer DC control electrodes symmetric about a central trap axis and suspended over an opening in a substrate. Neighboring ion traps in the array can share a common outer DC control electrode. The ions confined transversely by an RF quadrupole electric field potential well on the ion trap axis. The array can trap a wide array of ions.

9 Claims, 15 Drawing Sheets

MICROFABRICATED LINEAR PAUL-STRAUBEL ION TRAP

CROSS-REFERENCE TO RELATED APPLICATION

This application claims the benefit of U.S. Provisional Application No. 60/982,160, filed Oct. 24, 2007, which is incorporated herein by reference.

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to mass spectrometry and, in particular, to microfabricated linear Paul-Straubel ion trap that can be used to trap and filter gaseous ions.

BACKGROUND OF THE INVENTION

A mass spectrometer (MS) is a device that filters gaseous ions according to their mass-to-charge (m/z) ratio and measures the relative abundance of each ionic species. Mass spectrometry is particularly attractive for in-situ analysis, due to its inherent speed, excellent sensitivity, molecular selectivity, and capability for continuous real-time measurements. A typical mass spectrometer comprises an ion source, wherein the ions are generated; a mass filter, wherein the ions are separated in space or in time; an ion detector, wherein the filtered ions are collected and their relative ion abundance measured; a vacuum system; and means to power the spectrometer. Depending on the type of sample and the method of introducing the sample into the mass spectrometer, ions can be generated in the ion source by electron impact ionization, photoionization, thermal ionization, chemical ionization, desorption ionization, spray ionization, or other processes. Mass spectrometers are generally classified according to the method on which mass filtering is accomplished using electric and/or magnetic fields. Mass filter types include magnetic-sector, time-of-flight, linear quadrupole, ion cyclotron resonance, and ion traps. Detection of ions is typically accomplished by a single-point ion collector, such as a Faraday cup or electronic multiplier, or a multipoint collector, such as an array or microchannel plate collector, whereby all of the ions arrive at the collector simultaneously.

Mass spectrometer performance is generally given in terms of mass range, resolution (i.e., resolving power), and sensitivity of the instrument. Mass range is the lowest and highest masses that can be measured. A large mass range is desired for the analysis of high molecular weight organic and biological analytes. Resolution measures the ability of the instrument to separate and identify ions of slightly different masses. Typically, the resolution for singly charged ions is given by $$R = \frac{m}{\Delta m}$$

where m is the mass of an ion peak in atomic mass units and Δm is the width of the peak at some peak height level (e.g., half peak height). In many cases, the minimum resolution required is such that a molecular ion can be resolved from an adjacent peak having a unit mass difference. According to this requirement, the resolution R should be at least 100 for a chemical species having a nominal mass of 100. High-resolution instruments, required for organic mass spectrometry, can detect peaks separated by fractions of a mass unit. Sensitivity is a measure of the instrument's response to ions of an arbitrary m/z ratio for a particular sample. Sensitivity is typically a function of the efficiency of the ion source and ion detector, as well as the analyzer method used. The sensitivity limit, or detection limit, is the minimum amount of a sample that can be detected under a given set of experimental conditions and distinguished from the instrument noise level and background. Resolution and sensitivity are approximately inversely related to each other. Other important characteristics of a spectrometer instrument include overall size, operating pressure, voltage, and power consumption.

Mass spectrometers can be used for chemical sensing. A pulse of sample gas can be injected directly into the ion source of the mass spectrometer. However, analyzing mixtures may be difficult when the mass spectrometer is used alone, since the resulting mass spectrum would be a complex summation of the spectra of the individual components. Therefore, analytical techniques combining the separation methods of gas chromatography and mass spectrometry are often used for chemical sensing. A gas chromatograph (GC) separates volatile mixtures into their component chemical species, which are eluted from a long capillary. The eluents can then be transferred into a mass spectrometer to obtain a mass spectrum of each of the separated components, from which the molecular structure of the individual component species can be inferred. The GC/MS is therefore capable of separating highly complex mixtures, identifying the components, and quantifying their amounts. Alternatively, tandem (MS/MS) or multistage ($MS^n$) mass spectrometers can be combined, wherein one of the mass spectrometers is used to isolate individual ions according to their m/z ratio, and the other is used to examine the fragmentation products of the individual ions. Thus, multiple stages of mass analysis can be obtained in a single analyzer.

Recently, there has been a growing interest in miniature mass spectrometers that enable reduced size, power requirements, vacuum system demands, cost, and complexity. In particular, a microfabricated mass spectrometer combined with a microfabricated GC would enable a very attractive portable, handheld microanalytical system. Such a "chemical laboratory on a chip" would enable the rapid and sensitive detection of particular chemicals, including pollutants, high explosives, and chemical and biological warfare agents in the field.

Because magnetic separators do not scale well into the microstructure size range, most microfabricated mass filters have performed separation using time-varying electric fields (i.e., Paul-type traps). The 3D quadrupole ion trap (QIT) consists of two hyperbolic endcap electrodes with their foci facing each other and a hyperbolic ring electrode halfway between the two endcap electrodes. Ions are trapped in the space between these three electrodes by RF and DC electric fields. The QIT is well suited to miniaturization due to pressure intolerance and low voltage and power requirements. Cylindrical ion traps (CIT), comprising flat endcap electrodes and a cylindrical ring electrode, have much simpler geometries than the QIT. Massive arrays of such CITs have been fabricated on a micro-scale. See U.S. Pat. Nos. 6,870,158 and 7,154,088. However, such CITs are difficult to fabricate on the micro-scale, require high RF driving powers, and require unconventional ion detection schemes due to their relatively closed geometry.

The linear Paul ion trap is a two-dimensional version of the 3D QIT. A quadruple mass spectrometers based on the conventional linear Paul trap filters ions by passing them through tuned radiofrequency (RF) and direct current (DC) electrical fields defined by four symmetrically-spaced parallel rods within which a 2D quadrupole field is established. The QMS permits only those ions with a stable trajectory, determined by their m/z ratio, to travel along the entire length of the central axis of the rod assembly without being deflected out of the intra-rod space. Ions with different m/z ratios can be scanned through the QMS by continuously varying the field between the quadrupole rods. Therefore, the QMS is a variable band-pass filtering ion optic.

The QMS is relatively pressure tolerant and can operate effectively at relatively high pressures (e.g., $10^{-4}$ Torr). Therefore, they are amenable to miniaturization due to the avoidance of bulky vacuum pumping systems. Miniature linear quadrupoles require lower drive voltages and higher RF drive frequencies to filter heavier ions and maintain resolution as the electrode dimensions decrease. Further, the linear ion trap has much greater efficiency for trapping externally generated ions and much greater ion trapping capacity, due to reduced space charge effects, than 3D QITs of the same volume. However, miniaturized linear ion traps require precise fabrication to maintain acceptable performance. See Z. Ouyang et al., *Eur. J. Mass Spectrom.* 13, 13 (2007).

Recently, there has been interest in microfabricated versions of the linear ion trap for quantum computing (QC). To increase the speed of QC operations, there has been an effort to reduce the size of trap dimensions. This has lead to the development of a microfabricated surface-electrode ion trap analog of the conventional four-rod Paul ion trap. With the surface-electrode ion trap, all of the trap electrodes reside on a single surface, with alternating flat RF and DC control electrodes, and the ions are trapped above the surface plane. Ions are confined transversely to the null ion trap axis of the RF quadrupole electric field and axial confinement and ion transport operations are controlled by the DC electric field. For QC applications, the control electrodes can be segmented along their length and appropriate static potentials can be applied to the different segments to enable longitudinal confinement of ions in a single trapping location and transportation of the ions between trapping locations. However, ion trap depths of the surface-electrode trap are very shallow, not much above the mean kinetic energy of the ions. Therefore, ion injection and trapping with a thermal ion source can be problematic. However, shallow pseudopotential depths are tolerable for quantum computing applications which use laser cooling to initialize the internal state of the ions. See J. Chiaverini et al., *Quantum Inf. Comput.* 5, 419 (2005); S. Seidelin et al., *Phys. Rev. Lett.* 96, 253003 (2006); and C. E. Pearson et al., *Phys. Rev. A* 73, 032307 (2006).

Many of the requirements for micro-scale ion traps for mass spectrometry differ from those for quantum computing. The basic requirements for a useful micro-scale ion trap for mass spectrometry are: an ionization method that enables ionizing many different atomic and molecular species such that nearly all component species in the sample can be ionized for analysis; an ability to trap many target species to enable species identification and the determination of relative concentrations of all of the components in the sample; and an ability to trap a large quantity of ions to enable direct detection of the ions with adequate sensitivity for analysis.

The present invention is directed to a microfabricated linear Paul-Straubel ion trap array that satisfies these requirements for mass spectrometry in a small package.

SUMMARY OF THE INVENTION

The present invention is directed to a microfabricated linear Paul-Straubel ion trap, comprising a substrate having an opening therethrough; a dielectric layer on the substrate, and two parallel inner RF electrodes disposed on the dielectric layer and suspended over the opening in the substrate, wherein an RF quadrupole electric field potential well is established on a trap axis in the plane between the RF electrodes when a radiofrequency potential is applied to the RF electrodes. Each RF electrode has a first end and a second end and the first ends can be electrically connected and the second ends can be electrically connected to form a rectangular structure. The ion trap can further comprise two parallel outer DC control electrodes deposed on opposite sides of the two parallel inner RF electrodes and symmetrically about the trap axis in the plane of the RF electrodes. At least one additional ion trap, comprising two additional parallel inner RF electrodes and two parallel outer DC control electrodes deposed on opposite sides of the additional parallel inner RF electrodes and symmetrically about the additional trap axis, wherein one of the outer DC control electrodes is a common DC outer electrode with a first trap, can form an array of ion traps.

The planar micro ion trap array is specifically designed for mass spectrometry applications. Microfabrication techniques can be used to fabricate the planar rectangular Paul-Straubel-type ion trap over an opening in a substrate, enabling ionization, trapping, ion accumulation, and ion ejection that can be used for detection of atomic and/or molecular ions. The substrate can comprise silicon, the dielectric layer can comprise silicon nitride, and the electrodes can comprise tungsten.

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

DETAILED DESCRIPTION OF THE INVENTION

Any system that produces a point with a vanishing electrode field can potentially trap ions. The Paul-Straubel ring trap, consisting of a hollow ring and a pair of distant compensation electrodes, has been demonstrated to trap ions with a more open structure than the conventional 3D QIT. A linear version of the 3D Paul-Straubel ring trap consists of a pair of rods driven by the same RF applied voltage. This electrode configuration has a zero field line midway between the two rods. See N. Yu and W. Nagourney, *J. Appl. Phys.* 77(8), 3623 (1995); G. R. Janik et al., *J. Appl. Phys.* 67(10), 6050 (1990); and C. A. Schrama et al., *Optics Comm.* 101, 32 (1993).

The present invention is directed to a microfabricated planar version of the two-rod Paul-Straubel ion trap comprising two inner parallel electrodes, forming a rectangular electrode structure, driven by an RF applied potential. Two outer parallel compensation electrodes on a common plane are driven by a DC control potential. A zero field line forms between the RF electrodes to provide an ion trapping zone in the plane. In a typical mass spectrometry application, ions are created in situ via electron bombardment and the resulting ions are ejected towards an ion detector. Alternatively, the ion trap can comprise three- or five-electrodes, similar to the symmetric surface-electrode traps used for quantum computing. However, ions are trapped above the center DC electrode in such ion traps, which can make ion ejection from the traps difficult when used for mass spectrometry.

Figure 1:
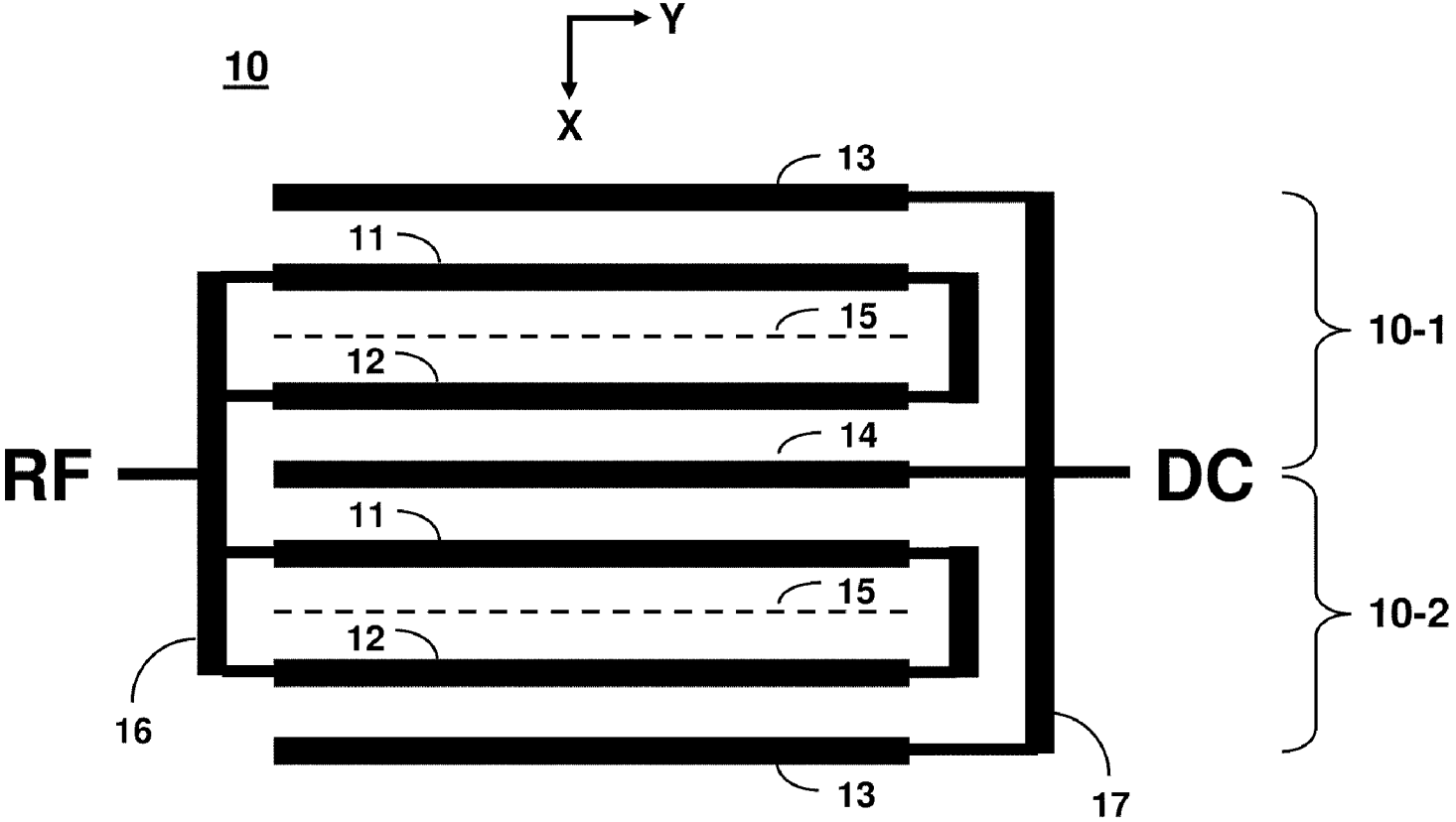
FIG. 1 is a top-view schematic illustration of an array comprising two planar linear Paul-Straubel ion traps.

FIG. 1 is a top-view schematic illustration of an array 10 comprising two parallel trapping zones, each consisting of a planar linear Paul-Straubel ion trap 10-1 and 10-2. Each ion trap 10-1 and 10-2 comprises two parallel inner RF electrodes 11 and 12 that can have their similar ends electrically connected to form a rectangular structure. An RF potential is applied to the two inner electrodes 11 and 12 of each ion trap. Each trap can further comprise two outer control electrodes 13 and 14 that can be held at RF ground. DC electrode 14 is common to neighboring traps 10-1 and 10-2. All of the electrodes reside in a single plane, with the ions confined transversely by an RF quadrupole electric field potential well on an ion trap axis 15 that is symmetric between the rectangular RF and DC electrodes of an ion trap and in the plane of the electrodes. The RF electrodes 11 and 12 end on a large bond pad 16 that completes the rectangular structure and defines endcaps for the trapping volume of each ion trap. The DC electrodes 13 and 14 can also be connected to a bond pad 17.

Figure 2B:
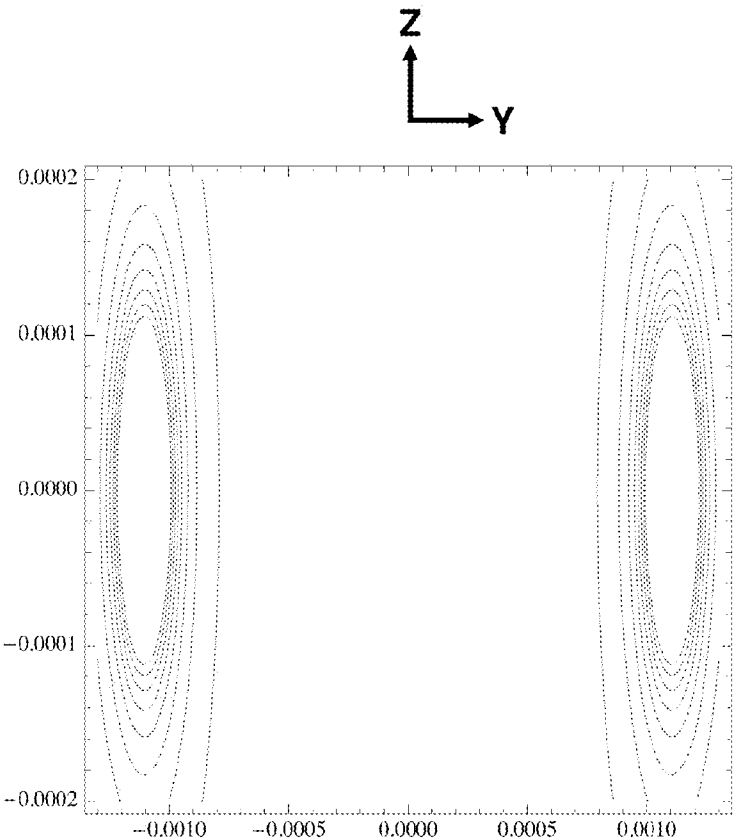
FIG. 2B is a plot of the trapping field in the Y-Z plane.
Figure 2A:
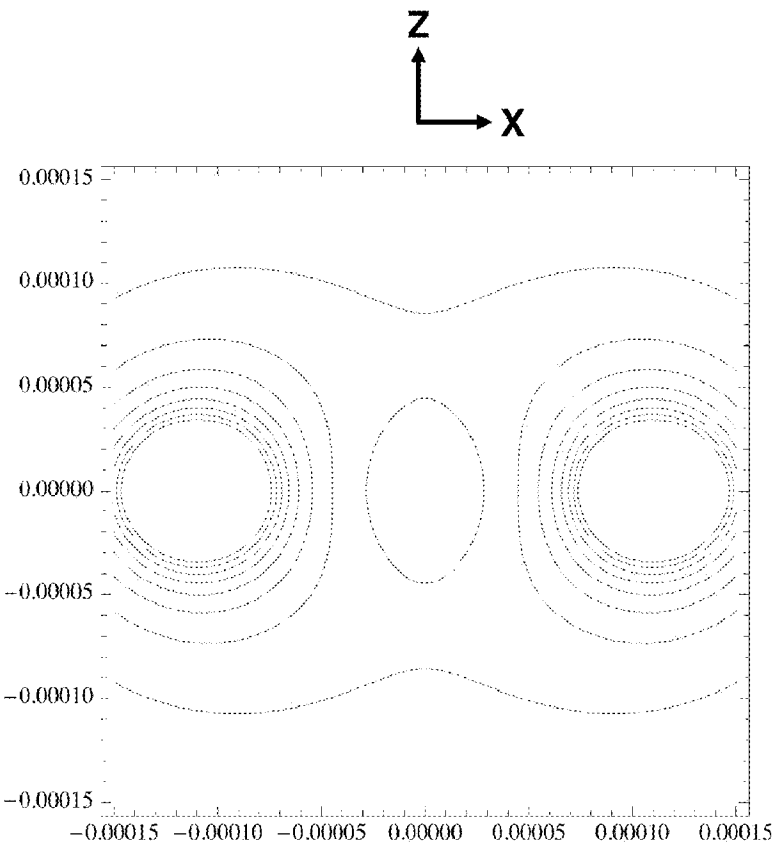
FIG. 2A is a plot of the trapping field of a planar linear Paul-Straubel ion trap in the X-Z plane, with a zero point between the electrodes.

FIG. 2A is a plot of the trapping field in the X-Z plane, with a zero point between the electrodes. This provides a confining region along the long axis of the trap (i.e., in the Y direction). FIG. 2B is a plot of the trapping field in the Y-Z plane. There is a field near the RF electrodes, but between them there is little effect of the field. This portion of the field acts as endcaps holding the ions in the confining potential formed in the X-Z plane.

Planar arrays of such ion traps can be fabricated on a substrate by micromachining techniques. The ion trap array provides a reasonably large trapping volume in a very small package. In particular, the relatively simple planar geometry is easy to fabricate and the common DC electrodes enables a scalable array comprising a plurality of ion traps. Scalability is important for mass spectrometry applications, since sensitivity is proportional to the number of ions trapped and detected.

The microfabricated ion trap array can be used in mass spectrometry applications. The ions can be created, accumulated and stored in the ion trap array. The ions can then be ejected as a function of their mass. In a single-stage mass spectrometer, the resulting ions can be ejected to an ion detector. In a multistage mass spectrometer, the ejected ions can be fed to a second-stage mass spectrometer, such as a quadrupole, time-of-flight (TOF) or magnetic sector instrument. A microfabricated array-based mass spectrometer preferably has reasonable sensitivity, mass range and mass resolution for the desired application while maintaining a small volume and low power requirement. When used with a chemical laboratory on a chip, a preconcentrator can be used to collect the sample of interest. The preconcentrator can release the collected sample as a pulse directly into the ion trap array or into an intervening GC column. The sample gas can be ionized in the trapping volume of the trap array. Ionization can occur for a period of time, in which the ions can accumulate in the traps of the array. After accumulation, the ions can be ejected from the trap as a function of the mass-to-charge ratio of the ions and detected directly by an ion detector, such as a microchannel plate (MCP).

Figure 3:
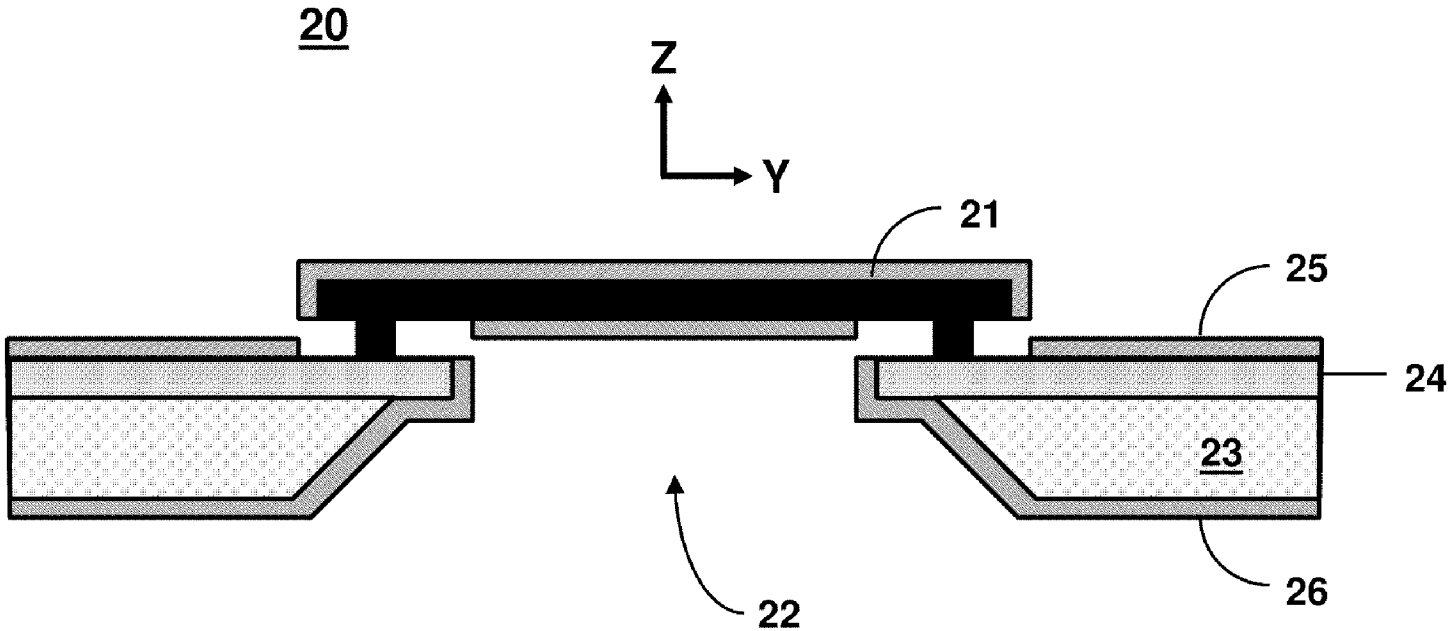
FIG. 3 is a side-view schematic illustration of a microfabricated ion trap electrode.

FIG. 3 is a cross-sectional side-view schematic illustration of a single microfabricated electrode structure 20. The illustrated structure comprises an RF or DC electrode 21 that bridges over a through-hole 22 in a substrate 23 that supports an ion trap array. An insulating layer 24 on the substrate 23 electrically isolates the electrode 21 from the substrate 23 and from adjacent electrodes. Exposed dielectric surfaces can hold charge and perturb the trapping field in the vicinity of the ions. Therefore, a conducting layer 25 on the front side of the structure can provide a ground plane to prevent the dielectric layer 24 from being seen by the ions. A conducting layer 26 on the back side of the structure can similarly provide a ground plane and eliminate exposed dielectric materials.

Microfabrication of the Planar Linear Paul-Straubel Ion Trap Array

A linear Paul-Straubel ion trap array, comprising a plurality of micro-scale linear Paul-Straubel ion traps, can be monolithically fabricated on a substrate by surface micromachining techniques generally known to the IC manufacturing and MEMS industries. Preferably, the ion trap array can be fabricated using a metal damascene process. Metal damascene is an inlaid process in which a trench is formed in a surface layer and a metal overfill is deposited into the trench. Preferably, the metal damascene process comprises a molded tungsten process. A chemical-mechanical-polishing (CMP) step is used to re-planarize the surface and isolate the metal in the trench. In FIGS. 4A-4L is shown a cross-sectional side-view schematic illustration of a method to fabricate an array of ion traps over a through-hole opening in a substrate. Only a single exemplary electrode of a multi-electrode ion trap array is shown to illustrate the fabrication process.

Figure 4A:
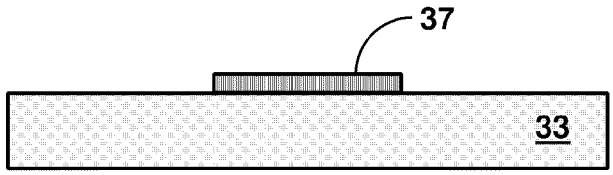
FIGS. 4A-4L is cross-sectional side-view schematic illustration of a method to fabricate an array of ion traps over a through-hole opening in a substrate.

In FIG. 4A, an insulating or semiconducting substrate 33 is provided on which the structure of the ion trap array can be fabricated. The substrate 33 is preferably a silicon-on-insulator (SOI) wafer, for example comprising a base silicon layer of about 650-700 microns thickness, a buried silicon oxide layer of about 4 microns thickness, and a top silicon layer of about 50 microns thickness. A sacrificial layer 37 is deposited on the substrate to provide for a material layer that can be etched away in later processing steps. For example, the sacrificial layer can be about 1 micron of silicon dioxide ($SiO_2$). The sacrificial layer 37 can then be patterned to remove the sacrificial material from the surface where the through-hole opening 22 is to be formed in the dielectric layer 24.

Figure 4B:
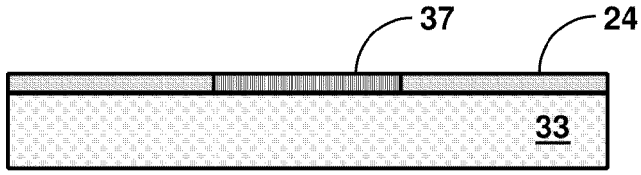

In FIG. 4B, a dielectric isolation layer 24 is deposited on the substrate to provide for electrical isolation of the electrode 21 from the substrate 23 in the final electrode structure 20, and for an etch stop. Low-stress silicon nitride ($Si_3N_4$) is a dielectric material with good mechanical properties that is compatible with IC processing steps. Therefore, the dielectric isolation layer 24 preferably comprises low-stress silicon nitride (e.g., about 1 micron thickness) deposited by chemical vapor deposition (CVD).

Figure 4C:
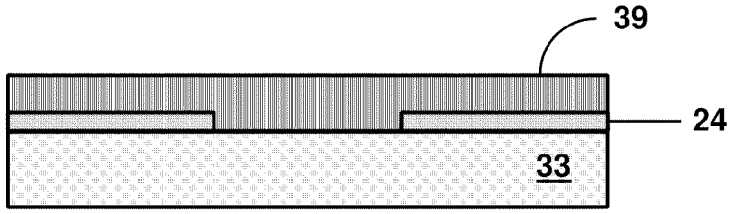

In FIG. 4C, another sacrificial layer 39 (e.g., 3-micron thick silicon dioxide) can then be deposited on the patterned silicon nitride layer and planarized.

Figure 4D:
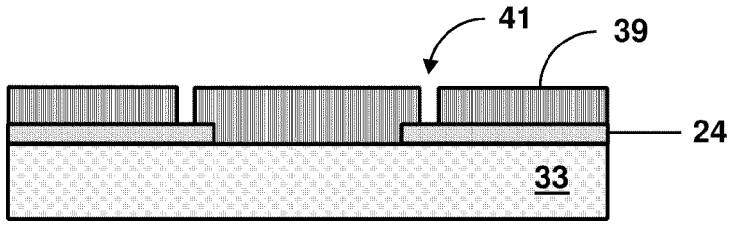

In FIG. 4D, the sacrificial layer can be patterned to form through-vias 41 for the electrode anchors 43. An anisotropic etching process (e.g., reactive ion etching directed normal to the surface) can be used to etch the vias down through the sacrificial layer 39 to the dielectric layer 24. The vias 41 should be deep enough to prevent the suspended electrode from collapsing following release of the ion trap structure.

Figure 4E:
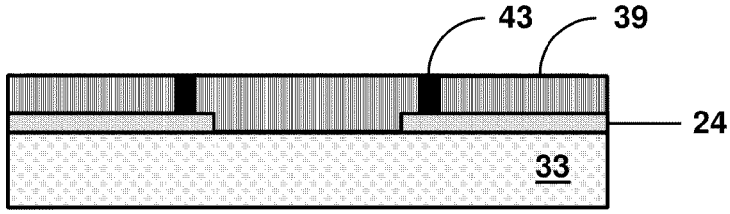

In FIG. 4E, the vias 41 in the patterned sacrificial layer 39 are backfilled by a blanket deposition of an excess of electrode material. The electrode material is preferably a good electrical conductor with a small RF skin depth, such as tungsten, aluminum, copper, titanium nitride, nickel, chromium, or other interconnect metal, that has sufficient structural strength to span the opening in the substrate. For example, the electrode material can be tungsten that is chemical vapor deposited at high pressure from $WF_6$ and $H_2$. Because CVD tungsten does not adhere to silicon dioxide, the CVD tungsten can be grown on a 25 nm TiN adhesion layer deposited by reactive sputtering on the patterned sacrificial oxide layer. The excess tungsten is removed and the surface of the filled patterned sacrificial layer to provide the electrode anchors 44. The surface can be planarized by CMP.

Figure 4F:
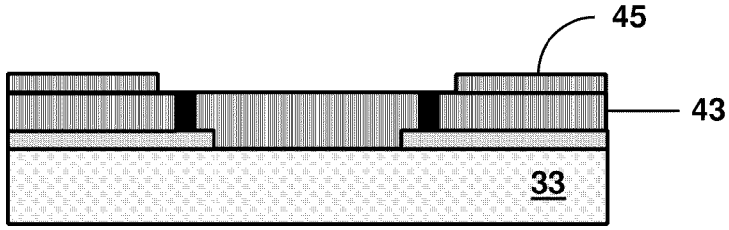

In FIG. 4F, another layer of sacrificial material is deposited on the electrode anchor layer and patterned to define an opening for the RF or DC electrodes 21. A photolithographic etch mask can again be used to pattern the sacrificial oxide layer.

Figure 4G:
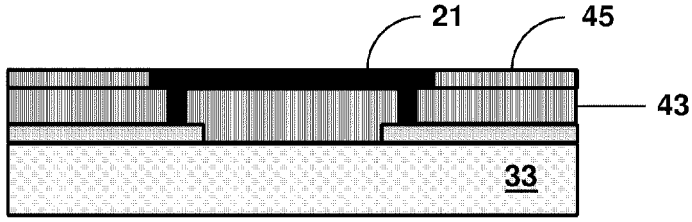

In FIG. 4G, the patterned sacrificial layer 45 is backfilled with the structural electrode material (e.g., CVD tungsten) and planarized.

Figure 4H:
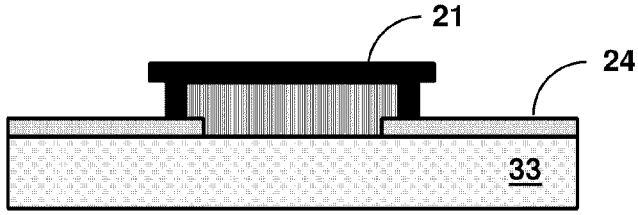

In FIG. 4H, the exposed sacrificial material can be removed by etching in a selective etchant to expose the electrodes 21 anchored to the dielectric layer 24. For example, sacrificial oxide can be removed by etching with a HF solution, with etches $SiO_2$, but not W, $Si_3N_4$, or Si.

Figure 4I:
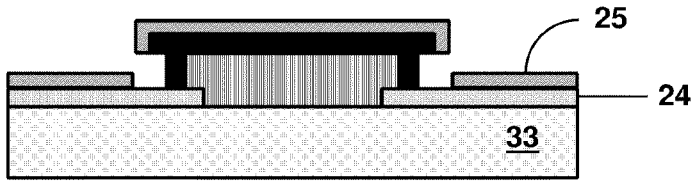

In FIG. 4I, a thin electrically conducting layer 25 can be blanket deposited over the front side of the exposed structure to lower the resistance of the device and create a conductive ground plane that prevents the underlying dielectric layer 24 from being seen by the ions. The conducting layer can be thermally evaporated Al-5% Cu.

Figure 4J:
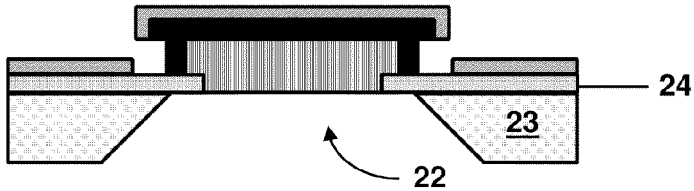

In FIG. 4J, an opening 22 for the suspended electrodes 21 can be formed by back-side etching of the substrate. For example, either Bosch etching or KOH etching can be used to etch through the silicon wafer and stop on the silicon dioxide layer.

Figure 4K:
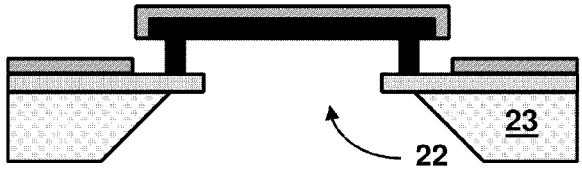
Figure 4L:
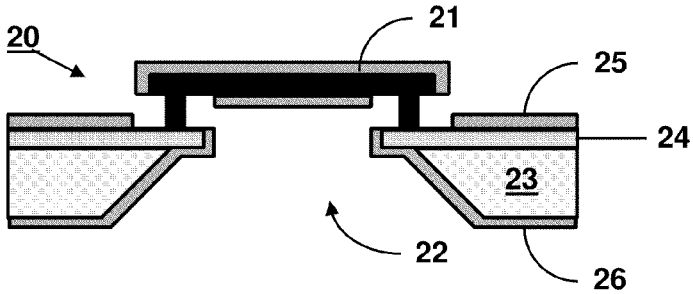

In FIG. 4K, the remaining exposed sacrificial oxide material can be removed using a wet chemical etchant to release the device and provide an array of ion trap electrodes 21 suspended over the opening 22 in the etched substrate 23.

In FIG. 4J, the back side of the released device 20 can be coated with a thin conducting layer 26 to create a grounded region and eliminate exposed dielectric materials. The conducting layer can be a gold layer that is thermally evaporated onto the back side of the device.

Experimental Verification of Ion Trapping

Proof-of-concept experiments were conducted to demonstrate the ability of the ion trap array to trap room temperature ions. The ion trap array comprised seven parallel linear Paul-Straubel ion traps suspended over an opening in a silicon chip that was fabricated according to the method described above. The opening in the chip was 2.2 mm by 3.8 mm. The electrodes were suspended over the opening to allow for ejection of the ions from the trapping zones for ion detection. Along the axial direction of the trap, each RF and DC electrode was approximately 2.2 mm in length, 10 microns in width, and 2 microns in thickness. Each of the seven trapping zones had an RF electrode to RF electrode separation of 100 microns and DC electrodes spaced 75 microns outside of the RF electrodes. Alternatively, the array can comprise asymmetric traps (arrays in which the RF electrode separations differ) to alter the m/z trapping properties of the traps on a chip with a common RF applied voltage. The seven trapping zones share DC electrodes, with the exception of the DC electrodes of the outer most trapping zones which are not shared. The applied RF voltage was 100 V amplitude (RF ground to maximum) and the resonance frequency was 27 MHz. The DC electrodes were held at RF ground.

Figure 5:
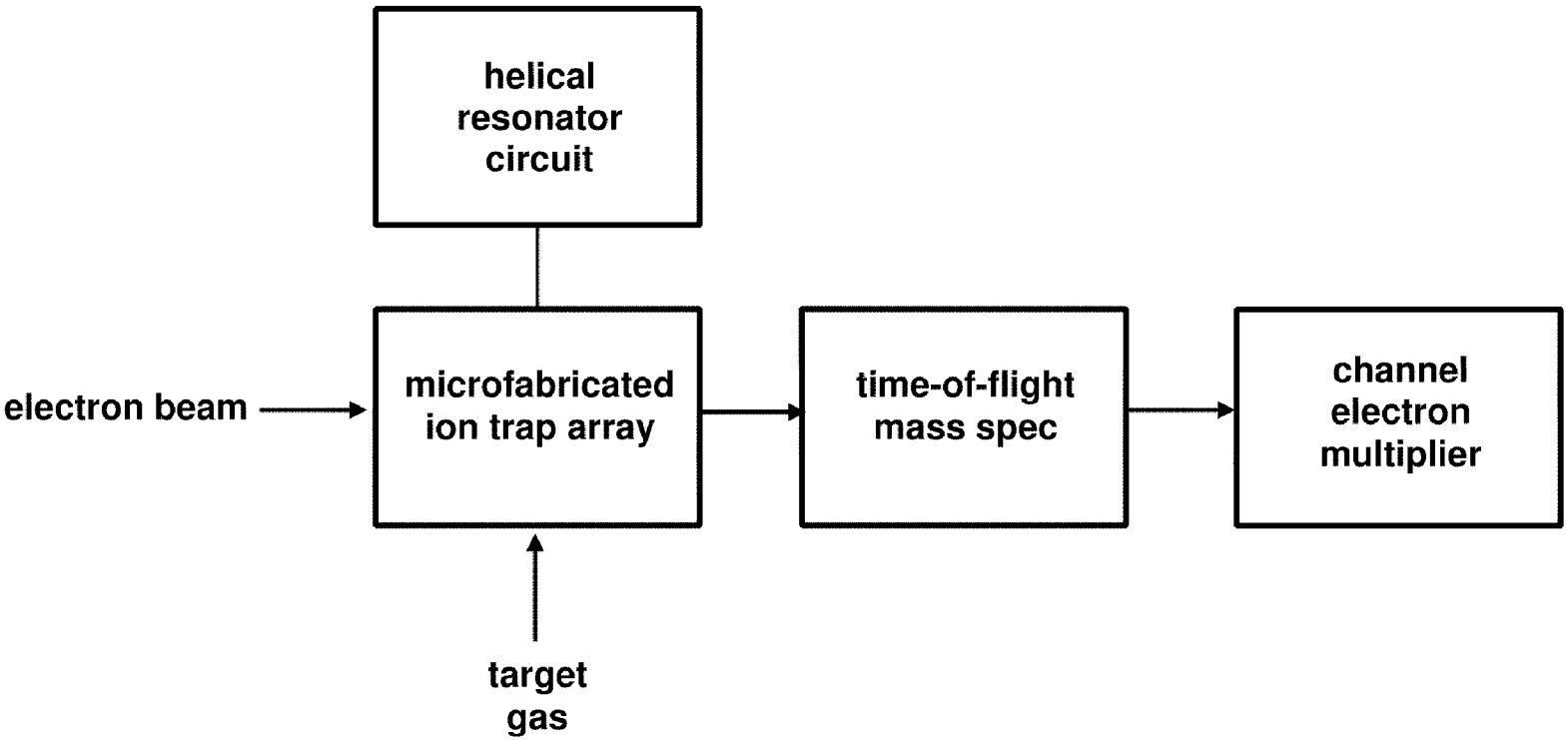
FIG. 5 shows a schematic illustration of an experimental setup that was used to demonstrate the ability of the microfabricated array to trap room temperature ions.

FIG. 5 shows a schematic illustration of the experimental setup. Electron impact ionization was used for the ion source. The trapped ions were dumped into a very short time-of-flight mass spectrometer which analyzed the mass-to-charge ratio of the ions. A channel electron multiplier (CEM) was used as the ion detector. The basic sequence of target gas introduction, gas ionization, ion trapping, and ion detection were repeated at a rate of 1.5 kHz allowing for an accumulation of data that was statistically meaningful.

Target Gas Introduction

Figure 6A:
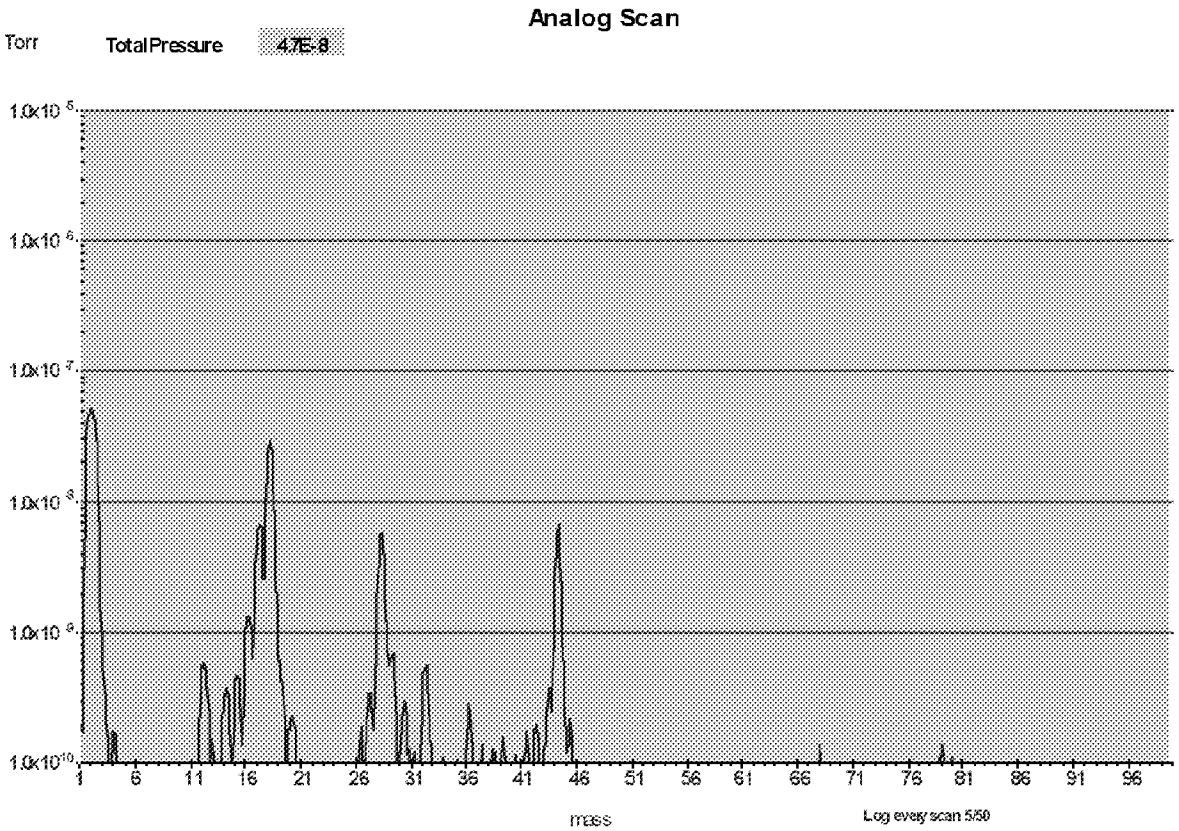
FIG. 6A is a residual gas analysis of vacuum without target gas added to a microfabricated ion trap array.
Figure 6B:
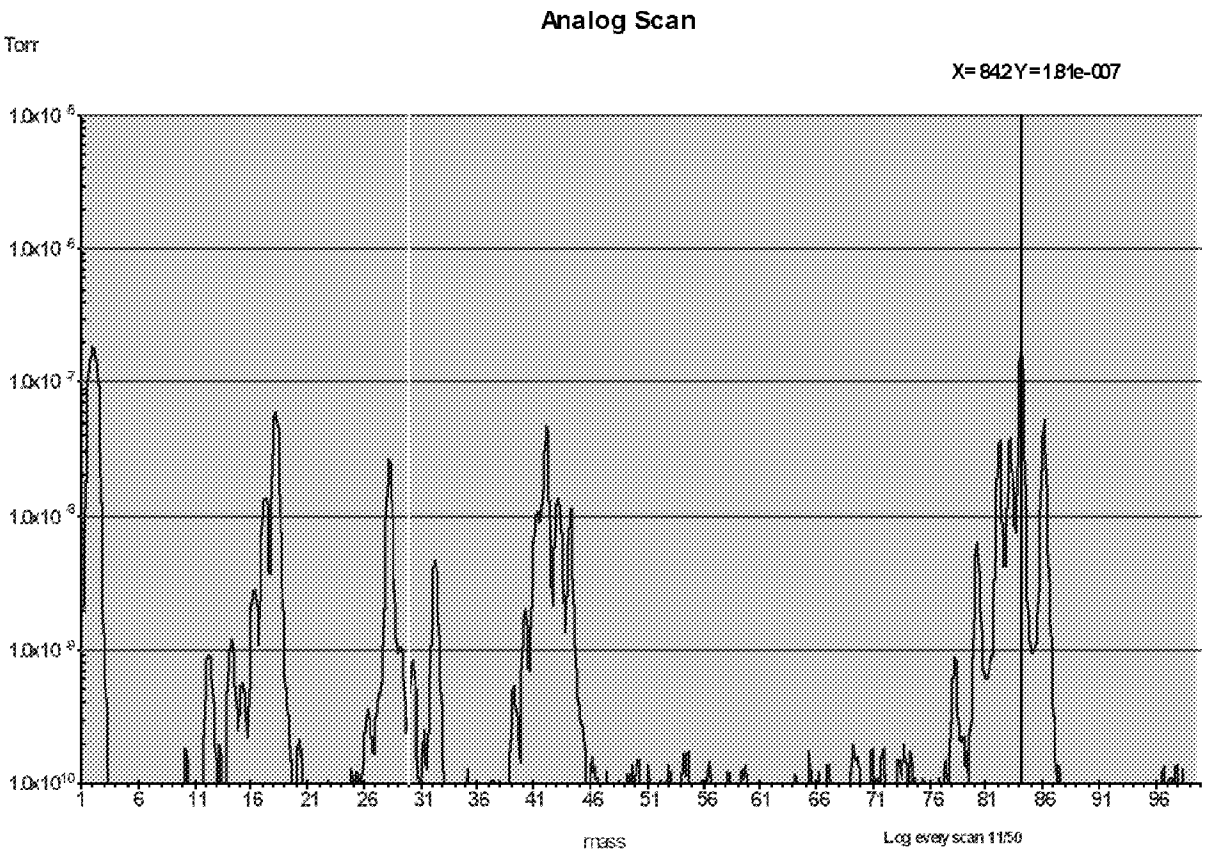
FIG. 6B is a residual gas analysis of vacuum with krypton flowing into the microfabricated ion trap array.

The target gases used in these experiments were krypton and nitrogen. Krypton has an atomic mass of approximately 84 and contains several nuclear isotopes. Nitrogen is a diatomic molecule of mass 28. The target gas was introduced to the ion trap array from a research grade lecture bottle via a gas handling manifold and an adjustable leak valve. Before introduction of the target gas, the vacuum chamber had a base pressure of approximately $2\times10^{-7}$ Torr consisting primarily of residual hydrogen, water, nitrogen, oxygen and carbon dioxide, as measured using a residual gas analyzer (RGA). A typical RGA scan of the chamber without a target gas present is shown in FIG. 6A. After the target gas was introduced, the pressure of the chamber rose to approximately $3\times10^{-6}$ Torr. A typical RGA scan of the vacuum system with krypton present is shown in FIG. 6B. During the experiment, the target gas was continuously passed into the chamber containing the array.

Ionization

Figure 7:
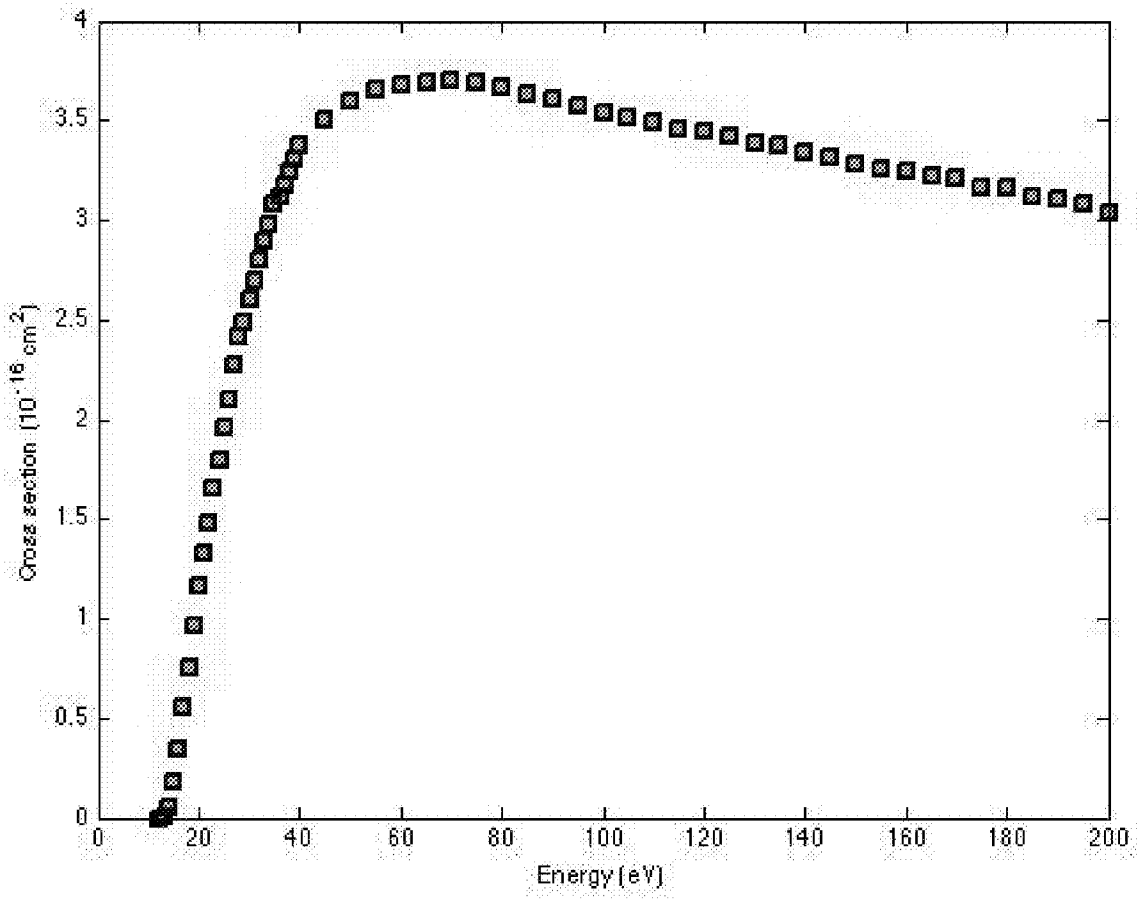
FIG. 7 is the electron impact ionization cross-section for the production of singly ionized krypton.

Electron impact ionization was used to produce ions from the target gas. Electron impact ionization is a reasonably efficient method of ionization that is general enough for ionizing most atoms and molecules. Tabulations of the electron impact ionization cross-sections and fragmentation species exist for many atoms and molecules. FIG. 7 shows the electron impact ionization cross section for singly ionized krypton. See Wetzel, R. C., et al., *Phys. Rev. A* 35(2), 559 (1987). The maximum ion production rate is at about 75 eV and slowly decreases as the electron impact energy increases. The electron impact ionization cross-section for $N_2^+$ is very similar in form and magnitude.

Figure 8A:
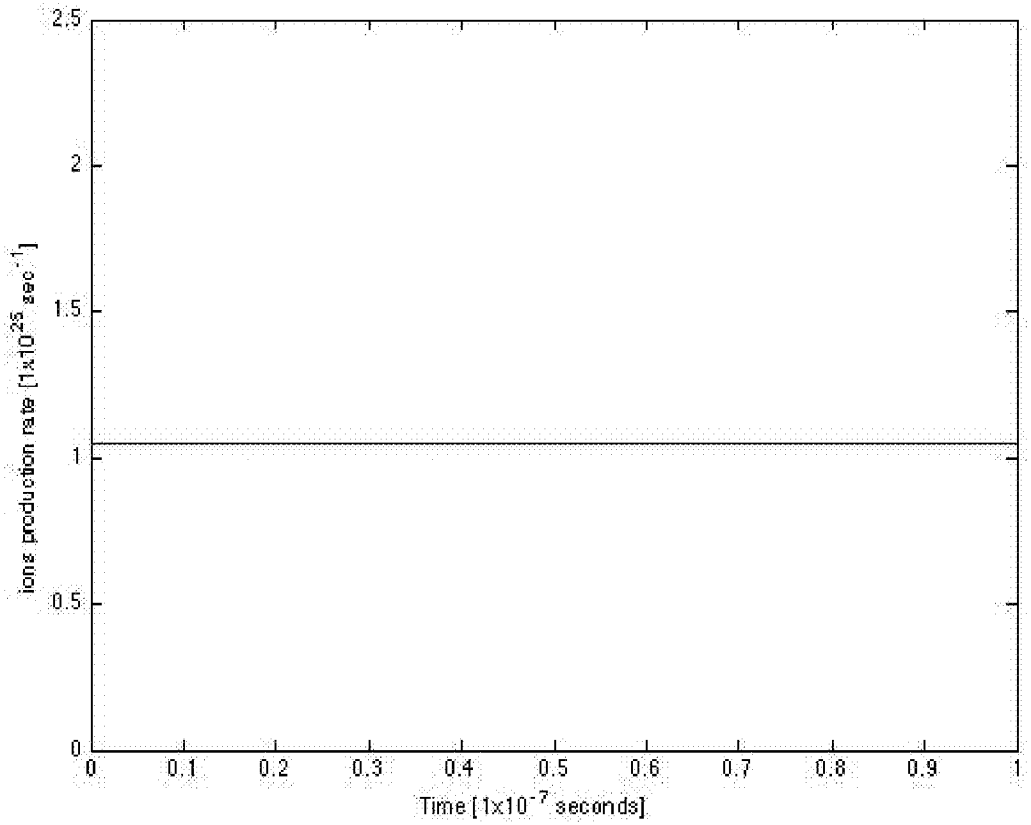
FIG. 8A is a model of the singly ionized krypton production rate without RF.
Figure 8B:
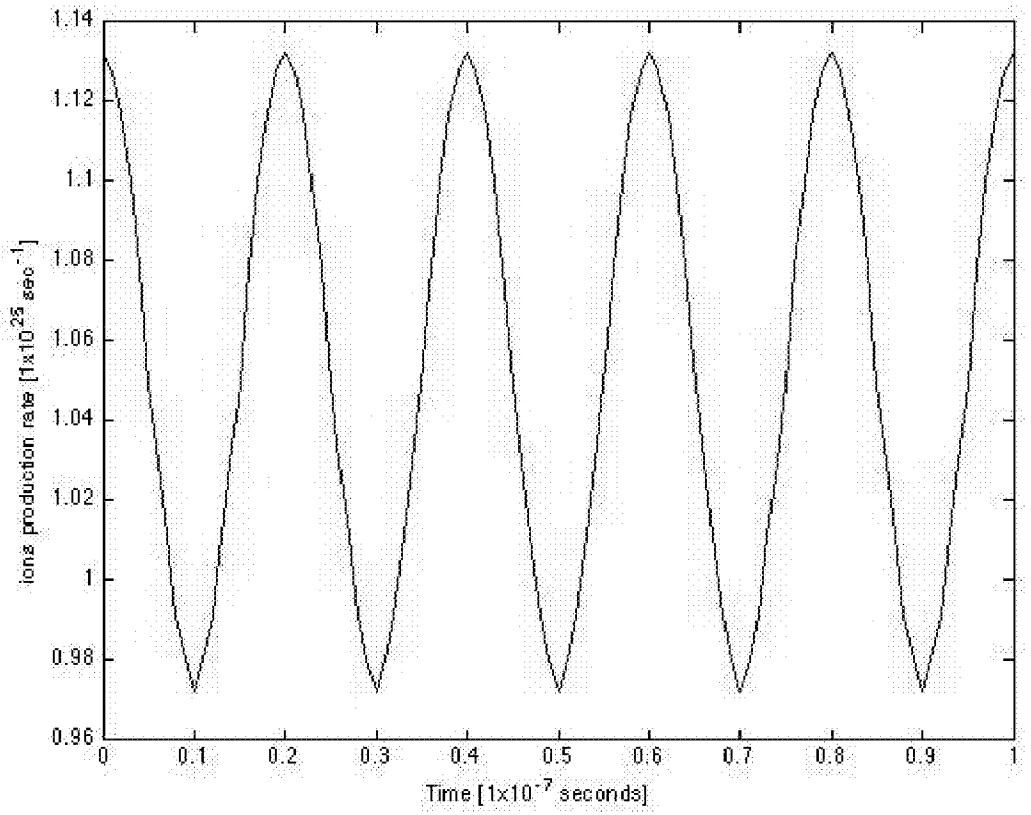
FIG. 8B is a model of the singly ionized krypton production rate with RF applied.

Since the ion trap depth is very shallow, the ions must be produced inside the trapping volume of the ion traps to be successfully trapped. The trapping volume is determined by the geometry of the traps and the applied RF and DC voltages. In these experiments, ions were produce with the RF voltage being applied to the trap. The presence of the RF alters the effective energy of the ionizing electrons, thereby affecting the ion production rate. A simple model was developed to illustrate the effect of RF voltage on the ion production rate. In this model, the energy of the electron beam was 150 eV, the RF amplitude was 50 V and frequency was 50 MHz, the target gas partial pressure was $1\times10^{-6}$ Torr, and ionization length was 1 mm. FIG. 8A shows the model result for the singly ionized krypton production rate without the RF applied. FIG. 8B shows the model result for the singly ionized krypton production rate with the RF voltage applied.

Figure 9A:
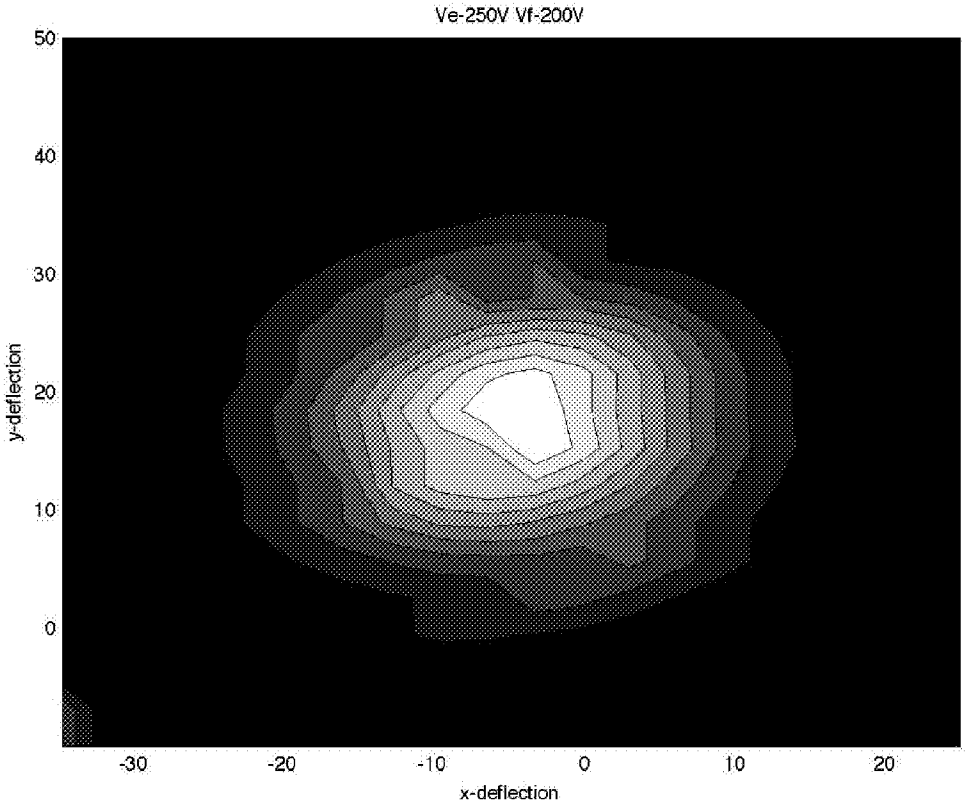
FIG. 9A is a plot of electron gun deflections for an energy of 250 eV focused near center of trap.
Figure 9B:
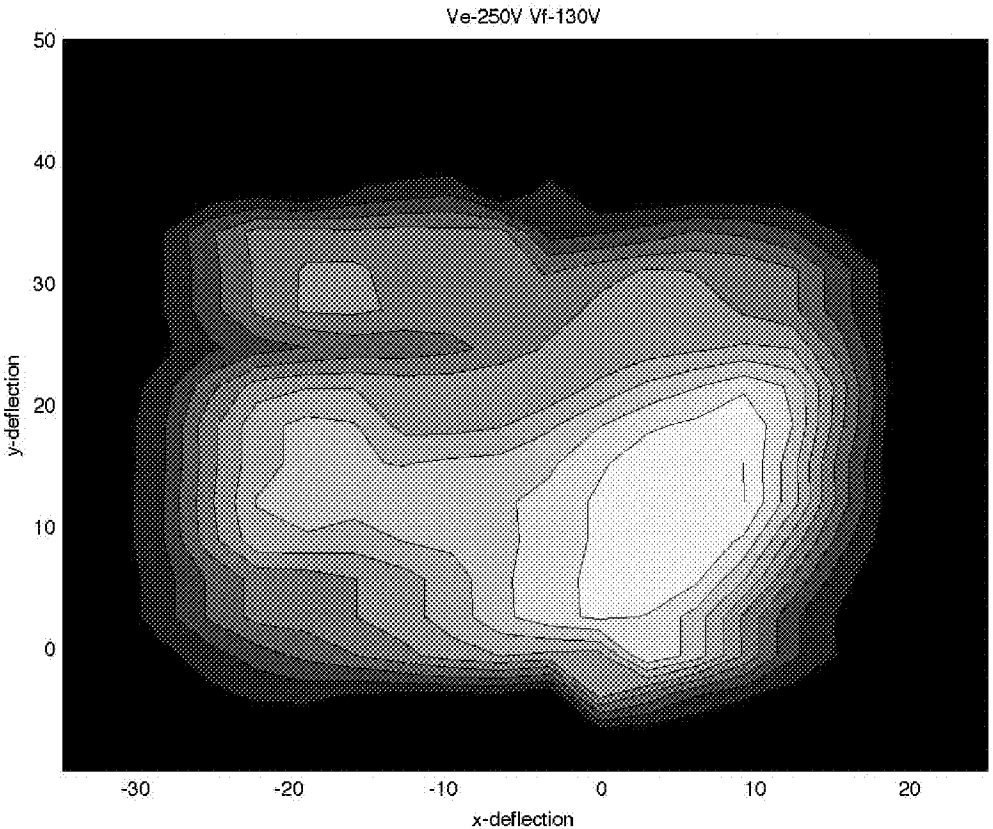
FIG. 9B is a plot of electron gun deflections for an energy of 250 eV defocused at center of trap.

A series of steps were taken to ensure electrons can ionize the target gas inside of the trapping volume. First, the electron beam was focused such that the focal point of the beam was at the trap chip opening. Second, the electron beam was rastered and the count rate of the CEM was monitored to determine the best x and y deflections to center the electron beam in the trap. Finally, the rastering of the electron beam was repeated under differing beam focus conditions to determine a focus condition that flooded the majority of the trap with electrons. Shown in FIGS. 9A and 9B are two examples of beam profiles collected in the rastering process. FIG. 9A shows the 'ideal' focus having the smallest waist of the beam passing through the trap. This focus has a round profile that essentially traces the detector entrance. FIG. 9B shows a focus that floods the majority of the trap and has a rectangular profile that is the profile of the opening on the trap chip.

A 150 eV electron beam was used in these experiments that was focused in a manner such that a large portion of the trap was in the electron beam path. Additionally, deflection voltages were determined to center the beam on the trap. For these experiments the electron beam was 'on' for 500 microseconds. Ions were produced during the 'on' period and some fraction of the ions produced were trapped. After the 10 microsecond 'on' period, the electron beam was turned 'off.'

Ion Trapping

A helical resonator circuit was built to effectively couple RF power to the ion trap array. For these experiments, an arbitrary waveform generator supplied a sine wave to a RF amplifier that fed the amplified RF to a helical resonator. The arbitrary waveform generator was configured to deliver a 27 MHz sine wave with amplitude of 0.3 V peak-to-peak. The RF power amplifier was set to deliver a RF signal to the helical resonator with 1 watt of power and an extraction pulse of +500 V was applied across a pair of grids surrounding the trap to extract ions for detection. The relationship between the voltage applied to the ion trap electrodes, the Q of the trap system, and the RF power applied to the resonator is:

$$V_{0\text{-}peak}=\alpha\sqrt{PQ}$$

$$12\leqq\alpha\leqq25$$

where V is the amplitude of the applied RF, P is the applied power in watts, Q is the quality factor, and α is a value that ranges from 12 to 25, as found in the literature. The voltage applied to the RF electrodes of the trap is an important consideration for both the trap depth, which determines the trapping stability for the various m/z ions species, and for the ion production rate.

Ion Detection

After a period of time in which the ions were created and accumulated in the trap, a high voltage pulse was applied to a grid above the trap forcing the ejection of ions toward the CEM detector. The time-of-flight of the charged particles from the trap to the detector is a function of the mass-to-charge ratio of the ions and the voltage of the extraction pulse applied to the grid. The pulse width of the extraction pulse was 10 microsecond with an extraction voltage of +500 V having an approximately 100 ns rise time. The transmission efficiency of the extraction grid was approximately 77.4%.

The ejected ions were detected with the CEM operating in a single particle detection mode. Each particle that impinged on the detector resulted in one count in a timing bin collected on a multi-channel scalar. The various timing bins of the multi-channel scalar are a discrete representation of the time-of-flight of the ions from the time the extraction pulse is applied to the time of ion detection. In these experiments, each bin was 5 ns wide and 1024 bins were scanned sequentially for each repetition of the experiments.

General Timing of the Experiment

The sequences of events for a given experimental run was as follows. Electrons were passed through the trap for 500 microseconds. During this time, the target gas was ionized and the trap RF power was on, causing the ions to accumulate in the trap. After the electron beam was turned off, the RF remained on for a period of time greater than 100 microseconds. During this period, the trapped ions were held in the trap and the non-trapped ions were allowed to neutralize. After the hold time, the RF was turned off and a 500 V extraction pulse was applied, sweeping the trapped ions from the trap towards the charged particle detector. Each ion that impinged on the detector resulted in a pulse that was counted as a function of the time-of-arrival at the detector using the CEM. This procedure resulted in a time-of-flight spectrum that demonstrates the ability of this device to trap thermal ions.

Experimental Results

Figure 10:
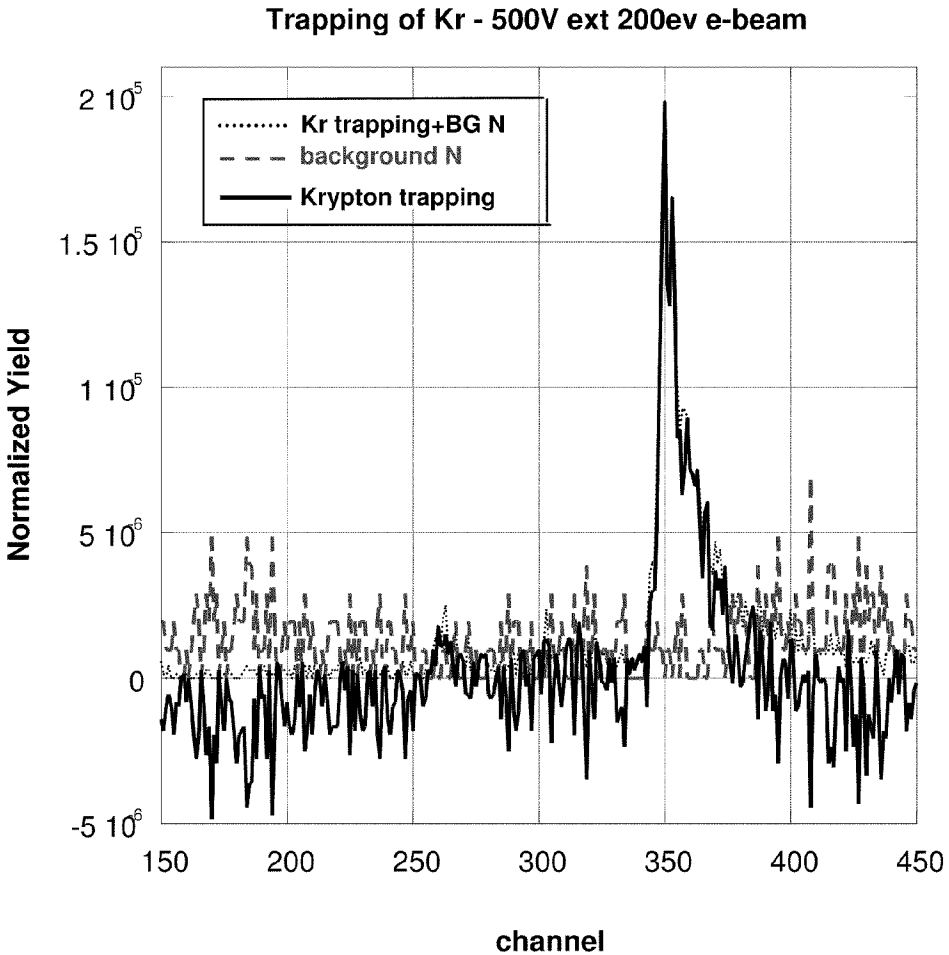
FIG. 10 is a graph of experimental data demonstrating the trapping of krypton. Dashed line is the background data with trap off, dotted line is trapping data without background subtraction, and the solid line is the krypton data minus the background.
Figure 11:
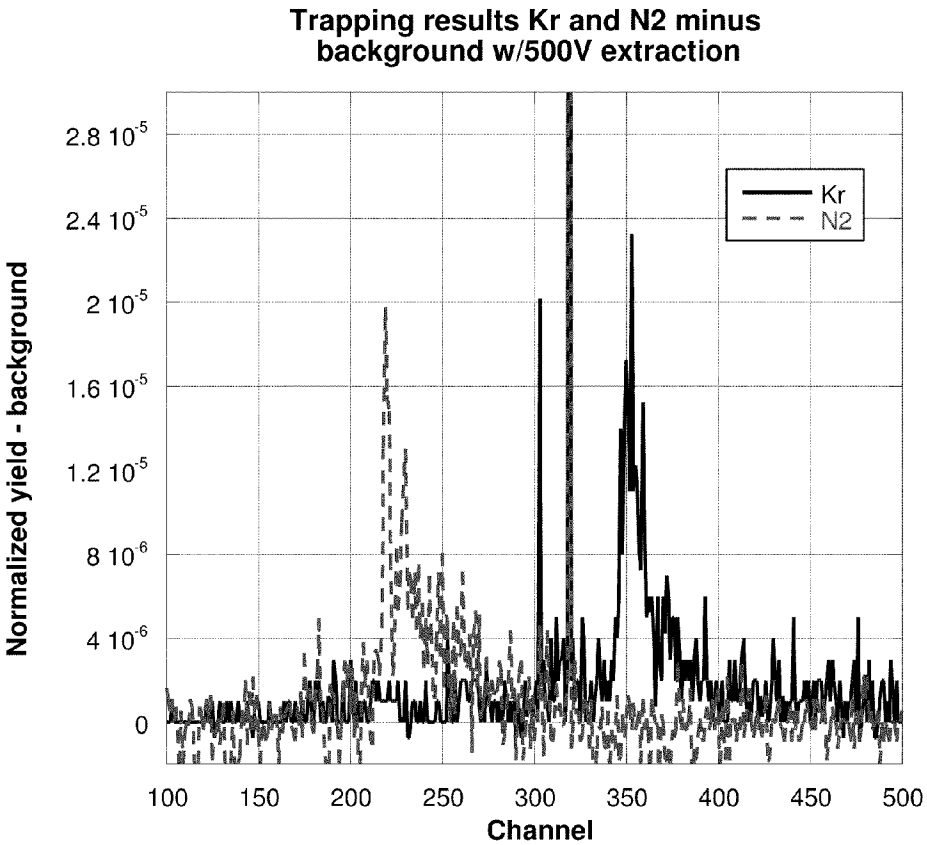
FIG. 11 is a graph of trapping results for nitrogen (dashed line) and krypton (solid line).

Time-of-flight spectra for krypton and nitrogen target gases were obtained using the ion trap array chip. The spectra were obtained from a typical trapping experiment as described above, whereby data was collected with trap off and trap on, whilst holding the other experimental parameters essentially constant. Background was collected with krypton in the system, with the electron gun on, and with the extraction pulses operating, but with no RF potential applied to the trap. This procedure allowed the background signal from the small number of non-trapped residual ions to be removed from the trapped ion signal that was obtained under the same conditions but with RF applied to the trap. The background signal was primarily random noise. The statistical significance of the ion peak in the spectra remained after the background subtraction. FIGS. 10 and 11 show the trapping spectra for nitrogen and krypton, respectively. The broad peaks are associated with ions being detected while the very narrow peaks are systematic noise found in the experimental test setup, primarily due to an impedance mismatch between the extraction grids and the extraction pulse source. These results demonstrate the ability of the microfabricated ion trap array to trap a broad mass range of ions.

The present invention has been described as a microfabricated linear Paul-Straubel ion trap. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A microfabricated linear Paul-Straubel ion trap, comprising:

a substrate having an opening therethrough;

a dielectric layer on the substrate, and two parallel inner RF electrodes residing on the dielectric layer in a single plane with a gap between the RF electrodes and suspended over the opening in the substrate, wherein an RF quadrupole electric field potential well is established on a trap axis in the gap between the RF electrodes when a radiofrequency potential is applied to the RF electrodes.

2. The ion trap of claim 1, wherein each RF electrode has a first end and a second end and the first ends are electrically connected and the second ends are electrically connected to form a rectangular electrode structure.

3. The ion trap of claim 1, further comprising two parallel outer DC control electrodes deposed on opposite sides of the two parallel inner RF electrodes and symmetrically about the trap axis in the plane of the RF electrodes.

4. The ion trap of claim 3, further comprising at least one additional ion trap comprising two additional parallel inner RF electrodes, disposed on the dielectric layer and suspended over the opening in the substrate and having an additional trap axis therebetween, and two parallel outer DC control electrodes deposed on opposite sides of the additional parallel inner RF electrodes and symmetrically about the additional trap axis, thereby forming an array of ion traps.

5. The ion trap of claim 4, wherein one of the outer DC control electrodes of each neighboring ion trap is a common DC outer electrode of the neighboring traps.

6. The ion trap of claim 1, wherein the substrate comprises silicon.

7. The ion trap of claim 1, wherein the dielectric layer comprises silicon nitride.

8. The ion trap of claim 1, wherein the electrodes comprise tungsten.

9. A microfabricated mass spectrometer, comprising:

an ion source for generating ions from a sample gas;

a microfabricated linear Paul-Straubel ion trap for filtering the generated ions from the ion source, the ion trap comprising:

a substrate having an opening therethrough; a dielectric layer on the substrate;

two parallel inner RF electrodes residing on the dielectric layer in a single plane with a gap between the RF electrodes and suspended over the opening in the substrate, wherein an RF quadrupole electric field potential well is established on a trap axis in the gap between the RF electrodes when a radiofrequency potential is applied to the RF electrodes, and two parallel outer DC control electrodes disposed on opposite sides of the inner RF electrodes and in the plane; and an ion detector for collecting the filtered ions.

* * * * *